US005566414A

United States Patent [19]

Nonaka

[11] Patent Number: 5,566,414

[45] Date of Patent: Oct. 22, 1996

[54] BRIDGE RAISING/SUPPORTING METHOD AND BEARING DEVICE FOR THE METHOD

[75] Inventor: Haluo Nonaka, Sakai, Japan

[73] Assignee: Matsuo Engineering Co., Ltd., Osaka, Japan

[21] Appl. No.: 325,872

[22] Filed: Oct. 19, 1994

[30] Foreign Application Priority Data

Oct. 20, 1993 [JP] Japan ..... 5-262052

[51] Int. Cl.[6] ..... E01D 19/04

[52] U.S. Cl. ..... 14/73.5; 14/77.1; 254/104

[58] Field of Search ..... 14/73.5, 77.1; 254/104

[56] References Cited

U.S. PATENT DOCUMENTS

| | | | |
|---|---|---|---|
| 2,327,297 | 4/1942 | Woodruff . | |
| 3,390,862 | 7/1968 | Schrepfer . | |
| 3,570,207 | 3/1971 | Launay | 52/745 |
| 3,774,352 | 11/1973 | Weber . | |
| 4,184,665 | 1/1980 | Queen, Jr. . | |
| 4,213,509 | 7/1980 | Häfner . | |
| 4,559,986 | 12/1985 | Svensson et al. . | |
| 4,944,492 | 7/1990 | Nonaka | 254/109 |

FOREIGN PATENT DOCUMENTS

| | | | |
|---|---|---|---|
| 0423029 | 4/1991 | European Pat. Off. | 14/73.5 |
| 55-126357 | 6/1980 | Japan . | |
| 60-22127 | 1/1985 | Japan . | |
| WO80/02172 | 10/1980 | WIPO . | |

*Primary Examiner*—James A. Lisehora

*Attorney, Agent, or Firm*—Armstrong, Westerman, Hattori, McLeland & Naughton

[57] ABSTRACT

A method of raising/supporting a bridge or the like on a lower structure involving sliding an upper wedge-shaped pressure receiving member having a slope on its lower face and a wedge-shaped drive member having a slope on its upper face relative to each other on their slopes by drive mechanism for driving the wedge-shaped drive member, to raise the upper face of the upper wedge-shaped pressure receiving member with respect to the lower structure. The method further involves regulating the upper wedge-shaped pressure receiving member and the wedge-shaped drive member from their relative movements after the bridge has been raised. The method further involves removing the drive member after the regulation of the relative movements of the upper wedge-shaped pressure receiving member and the wedge-shaped drive member.

11 Claims, 15 Drawing Sheets

BRIDGE RAISING/SUPPORTING METHOD AND BEARING DEVICE FOR THE METHOD

BACKGROUND OF THE INVENTION

1. Field of the Invention

The present invention relates to a bridge raising/supporting method for placing and replacing a bearing device to be sandwiched between an upper structure such as a bridge and a lower structure, and to the bearing device itself. More specifically, the present invention relates to a bridge raising/supporting method for placing a new bearing device even in such a narrow working site as could not replace the existing bearing device.

2. Description of the Prior Art

Between an upper structure (as will be called the "bridge") A such as a completed bridge or an express way supported by a bearing device and a lower support B supporting the bridge A, as shown in FIG. 15, there are sandwiched in proper positions a plurality of bearings C for transmitting a vertical load of the bridge A such as a dead load or an active load reliably to the lower structure B or for horizontally moving to absorb the extensions or contractions of the bridge A due to the temperature change and/or the horizontal movement due to earthquakes. These bearings C already placed (as will be called the "existing bearings") are often aged after a long time of years from the construction of the bridge A by the distortions due to the load or earthquake vibrations, the damages due to the bending stress, or the corrosions due to rain or sand to have their load absorbing function deteriorated or lost. If these existing bearings C are left as aged, they cannot absorb the individual loads upon the bridge A. As a result, the bridge A itself is often cracked or damaged and is broken down to cause a serious disaster. This danger makes it necessary to replace the aged existing bearings C by new ones.

In the prior art, the existing bearing C is replaced by the following method, as shown in FIG. 16. Near the existing bearing C, there are stacked metal plates or steel saddles to a level substantially equal to that of the existing bearing C to prepare a temporary support D. In the vicinity of the bearing C, there is placed a hydraulic jack E capable of raising the aforementioned bridge A while supporting it (as will be called "raising") to jack up (by several mm to 1 cm) the bridge A till the bridge A leaves the existing bearing C. Then, the bridge A is temporarily supported by a temporary bearing F made of several metal plates, and the existing bearing C is removed and replaced by a new one. After this, the bridge A is jacked up again to a level higher than the temporary bearing position to remove the temporary bearing F and is then jacked down. In addition to the method of replacing the bearing C described above, there are the known methods such as the bracket method or the special bed method to be adopted according to the conditions under which the bearing C is placed.

However, these methods cannot raise the bridge smoothly and still the worse require the works for placing the temporary supports D for the raising operations to elongate the term of works and raise the repair cost. In addition, the workers have to bear a heavy burden and a serious danger so that they are involved in an accident. Thus, we have invented a method of raising a bridge A or the like safely and easily and a device for use in the method, which has been patented and practiced, as disclosed in Japanese Patent Publication No. 54002/1992 or U.S. Pat. No. 4,944, 492. In the vicinity of the existing bearing C, as shown at (I) to (III) in FIG. 17, there is associated with pushing/pulling means 200 a wedge-shaped drive member 201 which has upper and lower sloped faces and which is sandwiched between two wedge-shaped pressure receiving members 202 and 203. As the wedge-shaped drive member 201 is pushed in the longitudinal direction by a hydraulic jack device 204, the wedge-shaped drive member 201 slides upward on the slope of the lower wedge-shaped pressure receiving member 203, as shown at (II) in FIG. 17, whereas the upper wedge-shaped pressure receiving member 202 slides upward on the slope of the wedge-shaped drive member 201 to raise the bridge A. In order to keep this state, moreover, a suitable number of horseshoe-shaped plate stopper members 207 are fitted across a sliding rod 206 of the jack device 204 in the space which is formed between a reaction receiving plate 205 of the hydraulic jack device 204 and the wedge-shaped drive member 201 to occupy the space thereby to regulate the movement of the wedge-shaped drive member 201 temporarily. In this meanwhile, the existing bearing C is repaired or replaced by the not-shown new bearing C'. After these series of works, the wedge-shaped drive member 201 is pulled in the longitudinal direction, as shown at (III) in Fig, 17, to lower the bridge A, thus ending the repairing or replacing works. Incidentally, during these repairing or replacing works of the existing bearing C, the bridge A is to be displaced or vibrated by the various fluctuating loads resulting from the traffic of vehicles, but these loads are absorbed by a slide plate 208, which is sandwiched between the upper wedge-shaped pressure receiving member 202 and the lower face of the bridge A, and by the not-shown shock absorbing plate. According to these method and device, the repair or replacement of the existing bearing C, which has been dangerous or impossible in the prior art, can be carried out safely and easily within a short time, as evaluated by those in the civil engineering and construction fields.

Our raising method and device have seemed to succeed in solving all the problems of the repairing or replacing works of the existing bearing. Although the method and device are effective in raising the bridge safely and smoothly, the hydraulic jack device 204 has to be left as attached, although unnecessary after the stopper members 207 have been fitted, so that the method and device are seriously wasteful.

On the other hand, the place for the existing bearing in the actual working site is various and beyond expectations. For example, some existing bearing C may have no working space for repairing or replacing itself. This seems to be caused by the fact that the construction of the bridge A at the early stage has taken no consideration into the necessity for providing the vicinity of the existing bearing C with a sufficient working space for the removal because the bridge A is placed on the bearings C set. The existing bearing C set on the follow-slam bridge or the like, as shown in FIG. 18, has little working space in the vicinity thereof, i.e., above the lower structure so that it may not be removed. Due to the damage such as the aging or buckling of the existing bearing C, moreover, the bridge A may sink from its initial reference position toward the lower structure B to narrow the gap between the lower structure B and the bridge A. In the worst case, not only the working space but also such a small space as to keep the existing bearing C out of touch may not be left. Especially in the concrete bridge, the problem is more serious because the gap between the lower face of the bridge A and the upper face of the lower structure B is designed to be narrow.

More specifically, our raising method and device described above is superior to the well-known method in that the bridge A can be raised safely and smoothly by inserting the raising device having a small height into the gap between the bridge A and the lower structure B. However, there is left and shared with the known method a problem in that the existing bearing C is repaired or replaced while the bridge A is being raised and supported. Specifically, in order to repair or replace the existing bearing C, there is necessary at least a working space S, as indicated by broken lines in FIG. 19. Thus, the aforementioned case cannot perform the repair or replacement of the existing bearing C physically because of no working space S for removing the existing bearing C. Of course, it is necessary not only to replace the existing bearing C but also to return the level of the sunk bridge A to the initial position. If, however, the existing bearing C is left as it is, the bridge A itself may collapse before long to invite a serious disaster as the existing bearing C breaks. Thus, what is taken is to replace the existing bearing C by the conventional method using the temporary support D, as shown in FIG. 16, or by lifting the bridge A itself by a large-sized crane, or to renew the bridge A and the lower structure B by large-scale works.

Therefore, we have made elaborate investigations and conceived the possibility of placing a new bearing even if no working space is left for replacing the existing bearing C, while abandoning the concept of the conventional method of repairing or removing the existing bearing C and replacing it by a new one by raising the bridge A. Thus, we have solved all the problems of the prior art by changing the concept into that the bearing itself has a function to raise the bridge while introducing the reaction and to stand for a long time while raising and supporting the bridge.

SUMMARY OF THE INVENTION

It is, therefore, an object of the present invention to provide both a bridge raising/supporting method for placing a new bearing device even in such a narrow working site as could not replace the existing bearing device, and a bearing device for use in the method.

In order to solve the above-specified problems, according to the present invention, there is provided a method of raising/supporting a bridge or the like on a lower structure, by sliding a upper wedge-shaped pressure receiving member having a slope on its lower face and a wedge-shaped drive member having a slope on its upper face relative to each other on their slopes by drive means for driving the wedge-shaped drive member, to raise the upper face of the upper wedge-shaped pressure receiving member with respect to the lower structure, wherein the upper wedge-shaped pressure receiving member and the wedge-shaped drive member are regulated from their relative movements after the bridge has been raised. In this method, the drive means may preferably be removed after the regulation of the relative movements of the upper wedge-shaped pressure receiving member and the wedge-shaped drive member.

The means for effecting the movement regulation may preferably include: projections formed on one of the upper wedge-shaped pressure receiving member and the wedge-shaped drive member and projected toward the other member; guide portions formed in the other member and sized to slide the projections; and one or more stopper members fitted in each of the spaces which are left in the guide portions after the slide of the projections. The stopper members may preferably be fitted in the guide portions from the side walls of the upper wedge-shaped pressure receiving member or the wedge-shaped drive member to regulate the relative movements of the two members.

Moreover, the drive means may preferably include: a hydraulic center hole jack; and a sliding rod extending through the jack and having its one end connected removably to the wedge-shaped drive member and its other end associated with the drive portion of the jack.

Still moreover, it is practical that a plate-shaped shoe is so sandwiched between the upper wedge-shaped pressure receiving member and the lower face of the bridge that the upper shoe and the plate-shaped shoe may slide on their contacting faces, whereby the displacement due to the vibrations and extensions or contractions of the bridge is absorbed sufficiently above the lower structure.

In order to practice the raising/supporting method described above, there is provided a device for bearing a bridge or the like, comprising: a upper wedge-shaped pressure receiving member formed with a slope on its lower face; a wedge-shaped drive member formed on its upper face with a slope having an equal sloping angle to slide on the slope of the upper wedge-shaped pressure receiving member and adapted to be pushed and pulled in its longitudinal direction; engaging portions including guide portions formed in one of the upper wedge-shaped pressure receiving member and the wedge-shaped drive member by notching those portions of the side walls thereof in the longitudinal direction as contain at least the edges between the side walls and the slope, and sliding projections formed in the other member and sized to move the guide portions only in the longitudinal direction; and stopper members adapted to be fitted in the spaces which are left in the guide portions after the sliding projections have moved in the longitudinal direction.

In the bearing device of the present invention, a plate-shaped shoe made of hard rubber may preferably be placed on the upper wedge-shaped pressure receiving member. Moreover, the bearing device may further comprise: a plate-shaped shoe made of hard rubber and having its lower portion fitted in a recessed portion formed in the upper face of the upper wedge-shaped pressure receiving member; and an upper shoe attached to the lower face of the bridge and slidably attached to the lower face of the bridge. It is practical that the plate-shaped shoe is formed at least on its upper face with a slide layer having a small sliding frictional resistance.

It is more practical that a base plate is formed on its upper face with both a sliding face for the wedge-shaped drive member and position regulating members for moving the wedge-shaped drive member only in the longitudinal direction and is laid below the wedge-shaped drive member and fixed on a lower structure for the bridge.

In order to provide an inexpensive bearing device practically, it is important that means is provided for moving the wedge-shaped drive member and includes a hydraulic center hole jack and a sliding rod extending through the jack and having its leading end removably connected to the wedge-shaped drive member and its other end associated with the drive portion of the jack so that the jack can be removed after the bridge has been raised.

In the bridge supporting/raising method and bearing device thus made according to the present invention, the wedge-shaped drive member and the upper wedge-shaped pressure receiving member are placed on the upper face of the lower structure in the vicinity of the existing bearing with their slopes being abutting against each other, so that the upper face of the upper wedge-shaped pressure receiving member is raised to raise the bridge. After this rise, the upper wedge-shaped pressure receiving member and the wedge-shaped drive member are regulated from moving relative to each other. Here, in case the movement regulating means adopted is exemplified by the engaging means including the projections, the guide portions and the stopper members, in the guide portions formed in one of the upper wedge-shaped pressure receiving member and the wedge-shaped drive member, there are fitted the projections which are provided on the other member, and the projections are positioned in the guide portions at the longitudinal ends such that the upper wedge-shaped pressure receiving member is placed above the wedge-shaped drive member. After the bridge has been raised, the upper wedge-shaped pressure receiving member and the wedge-shaped drive member are regulated from their relative movements by the stopper members so that the raised and supported state can be stably maintained for a long time to allow the bearing device to be used as it is. Incidentally, in case the bearing device is used together with the existing bearing, the reaction of the bridge is introduced into the bearing device of the present invention to lighten the burden upon the existing bearing which has its function deteriorated. In order to replace the existing bearing, according to the present invention, the bridge can be raised and supported for a short time and lowered after the existing bearing is replaced by a new one so that the bridge can be supported by the new bearing.

In case the upper face of the aforementioned lower structure is made of a concrete face having a high frictional resistance to make the wedge-shaped drive member reluctant to slide, there is interposed a base plate which is formed on its upper face with a sliding face to allow the wedge-shaped drive member to slide only in the longitudinal direction, and the base plate is fixed on the lower structure to make the wedge-shaped drive member movable. Next, in order to move the wedge-shaped drive member in the longitudinal direction, the sliding rod extending into the hydraulic center hole jack has its leading end fixed to the front face of the wedge-shaped drive member and its other end associated with the drive portion of the jack body, and the reaction receiving member is sandwiched between the jack body and the front face of the upper wedge-shaped pressure receiving member or the front face of the base plate. When the sliding rod is pulled, the wedge-shaped drive member 5 is moved together with the rod in the longitudinal direction so that the upper wedge-shaped pressure receiving member rises to raise the bridge as the slope of the wedge-shaped drive member and the slope of the upper wedge-shaped pressure receiving member slide on each other. At this time, the projections slide in the aforementioned guide portions to leave the spaces from the initial positions of the projections to the slid positions. When the bridge is raised to a suitable position, the raising works are interrupted while maintaining the pulling force, and the stopper portions are fitted in those spaces so that the wedge-shaped drive member is completely prevented from returning. Even if the aforementioned jack is then released and removed from the wedge-shaped drive member, the bridge is prevented by the aforementioned stopper members from being lowered from the raised position even it is displaced by the vibrations and extensions or contractions, so that the bearing device can be used with the remaining members.

In case, on the other hand, the plate-shaped shoe made of hard rubber has its lower portion fitted in the recessed portion formed in the upper face of the upper wedge-shaped pressure receiving member and in case the upper shoe attached on the lower face of the bridge is slidably placed on the plate-shaped shoe, the soil or sand deposits on the lower structure after a long use to bury the base plate and the wedge-shaped drive member thereby to make their relative movement impossible. Even in this case, the vibrations and extensions or contractions to be caused in the bridge can be absorbed by the plate-shaped shoe and the upper shoe which are so located above the upper wedge-shaped pressure receiving member that they are hardly buried with the deposit.

DESCRIPTION OF THE PREFERRED EMBODIMENTS

Figure 1:
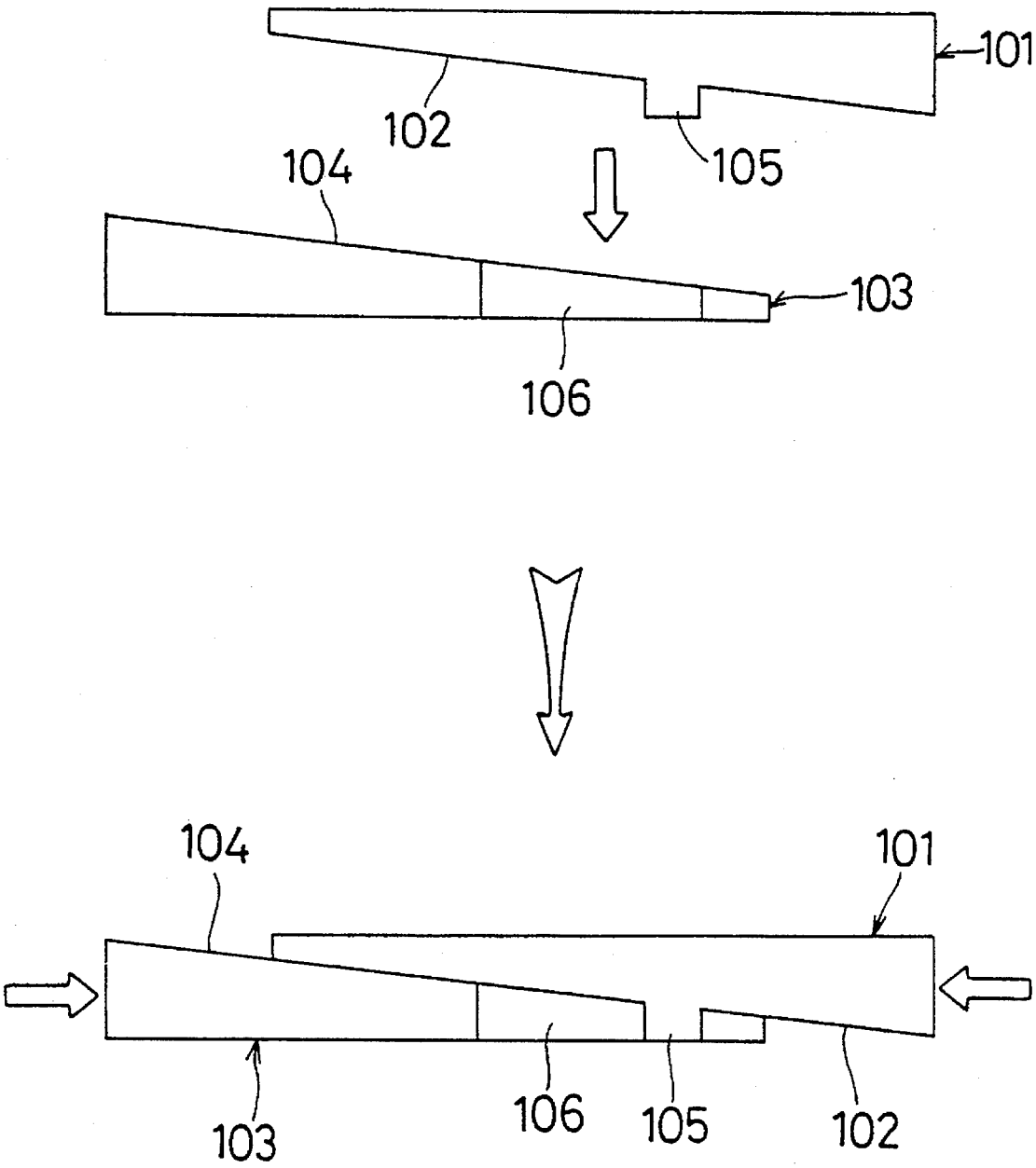
FIG. 1 is a conceptional diagram illustrating a raising/supporting method according to the present invention.
Figure 2:
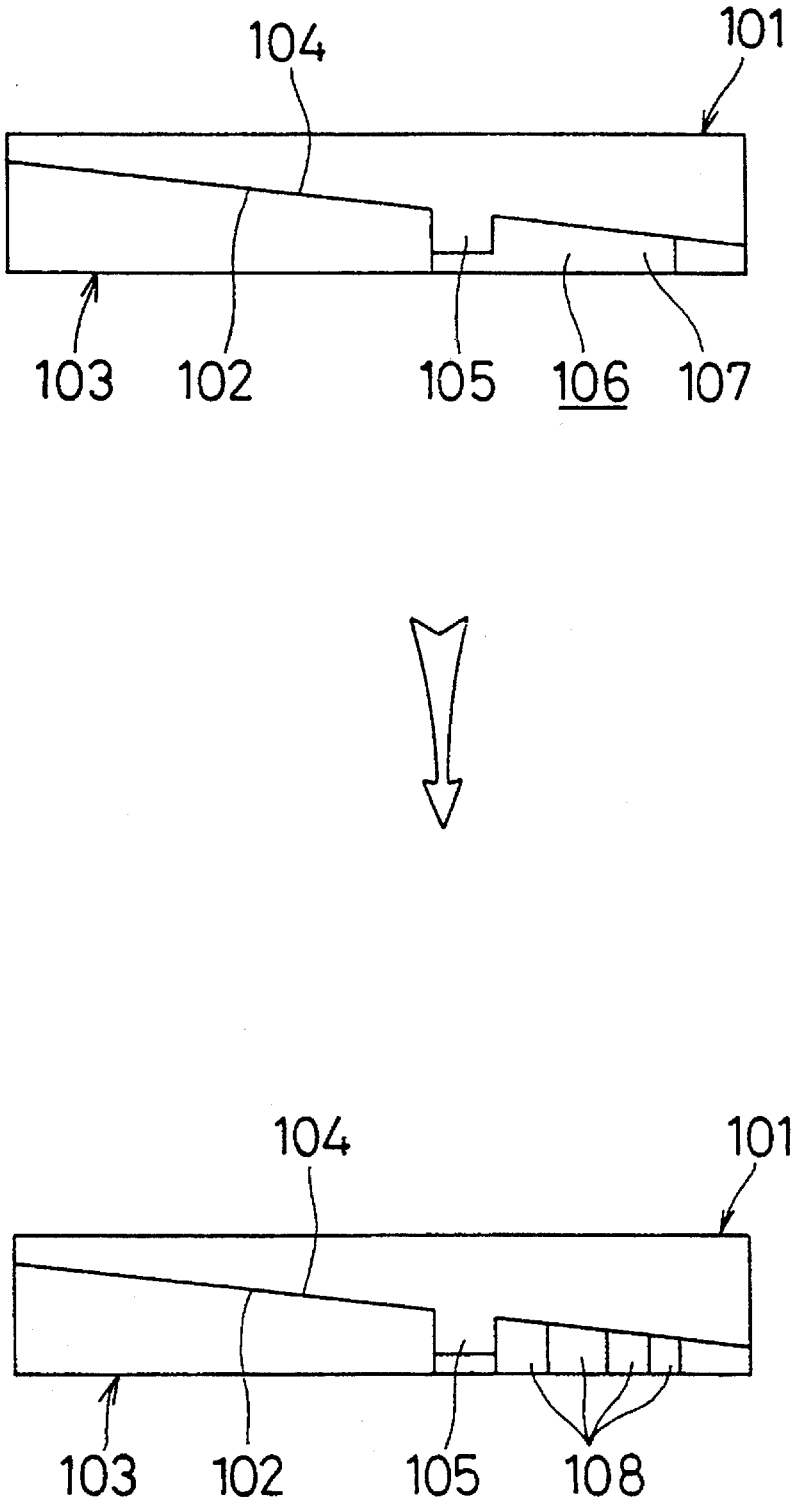
FIG. 2 is a conceptional diagram showing the raising/supporting method of the present invention.
Figure 17A:
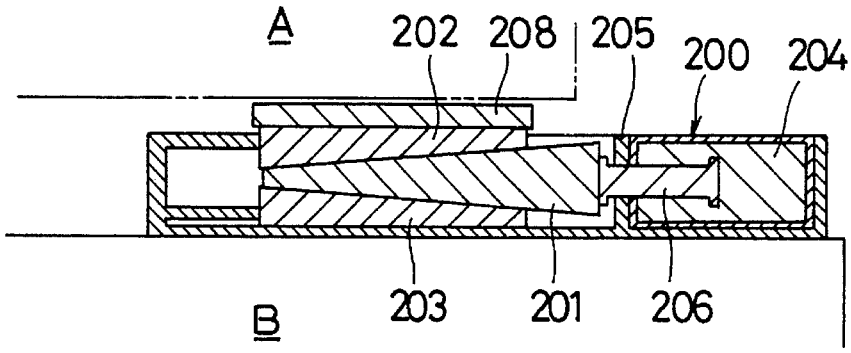
FIG. 17(A) PRIOR ART
In FIG. 17 presenting vertical sections, as taken from the central portion, illustrating the raising/supporting method and device of the prior art: (I) shows the state in which the raising/supporting device is set in a predetermined position; (II) shows the state in which the bridge is raised; and (III) shows the state in which the bridge is raised and supported.
Figure 17B:
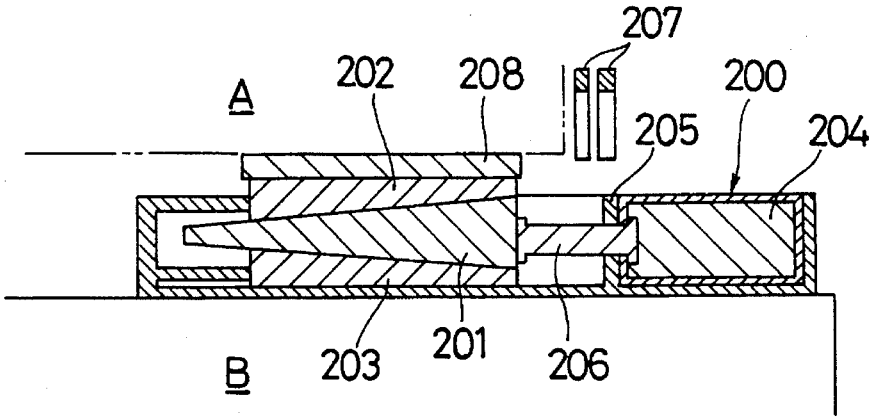
FIG. 17(B) PRIOR ART
Figure 17C:
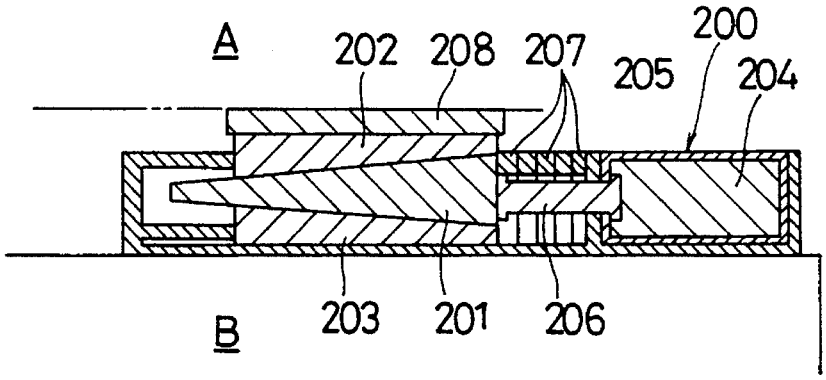
FIG. 17(C) PRIOR ART
Figure 18:
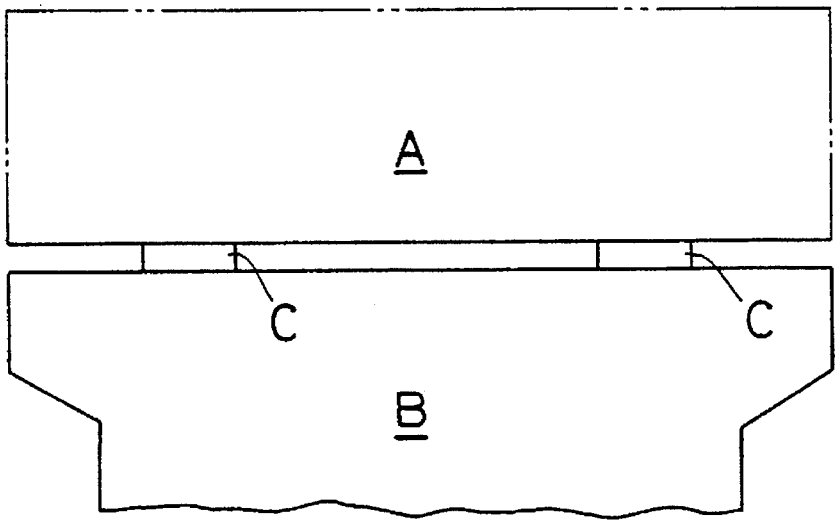
FIG. 18 is an explanatory diagram showing a working space.
Figure 19:
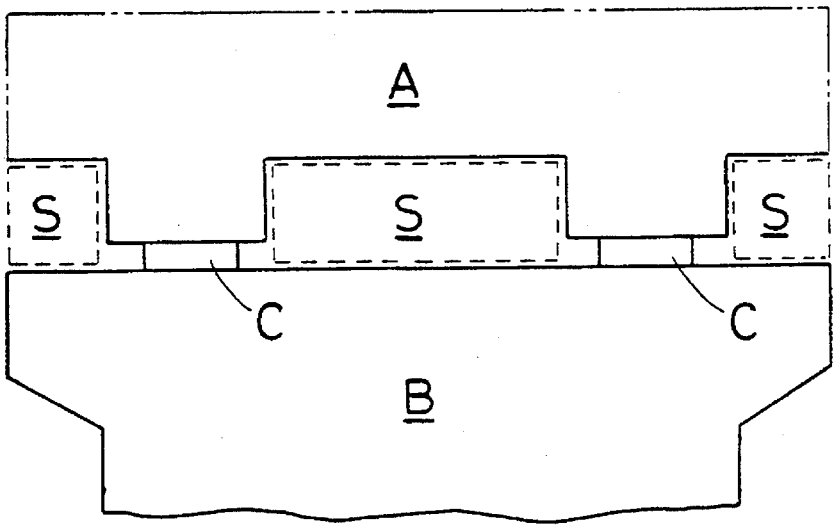
FIG. 19 is an explanatory diagram showing the working space.

The present invention will be described in detail with reference to the accompanying drawings. FIGS. 1 and 2 are conceptional diagrams showing the technical concept of the present invention. Reference numeral 101 designates an upper wedge-shaped pressure receiving member having a slope 102 on its lower face, and numeral 103 designates a wedge-shaped drive member formed with such a slope 104 on its upper face as can slide on the aforementioned slope 102. Thus, the wedge-shaped drive member 103 is moved in the direction to make the slopes 102 and 104 slide thereby to raise a heavy structure such as a bridge. Here, it is known in the prior art to raise the bridge or the like by using the wedge-shaped drive members having those slopes, as shown in FIG. 17, and to move and regulate only a wedge-shaped drive member 201 corresponding to the wedge-shaped drive member 103 of the present invention. However, the device of the structure depends upon the mounting strength of the reaction receiving member for bearing the individual loads so that it cannot stand the deflection to invite a danger for a long use. In the present invention, therefore, the upper wedge-shaped pressure receiving member 101 and the wedge-shaped drive member 103 are associated to have their movements regulated and are integrated so that they can offset the load acting in the direction along the slopes thereby to ensure a safety regulation even for a long use. Moreover, the upper face of the upper wedge-shaped pressure receiving member 101 and the lower face of the wedge-shaped drive member 103 can slide on each other to realize not only the raising support for a short period but also the bearing for a long period.

The means for regulating the movements of the upper wedge-shaped pressure receiving member 101 and the wedge-shaped drive member 103 is exemplified by forming one of the members 101 and 103 with a projection 105 directed to the other and by forming the other member with such a guide portion 106 as is sized to allow the projection 105 to slide therein. In the case of FIG. 1, for example, the projection 105 is formed to depend from the upper wedge-shaped pressure receiving member 101, and the guide portion 106 for allowing the projection 105 to slide therein is formed in the wedge-shaped drive member 103. Thus, the projection 105 is enabled to slide in the guide portion 106, as shown in FIG. 2, by pushing or pulling the wedge-shaped drive member 103 and/or the upper wedge-shaped pressure receiving member 101 by means of the known hydraulic jack device. As a result of this slide of the projection 105, there is established a space 107 which extends from the initial position to the slid position of the projection 105. This projection 105 is stopped to return by inserting such one or more stopper members 108 into that space 107 as is made of a hardly elastically deformable material such as a metal or a high polymer or a restorable material such as a shape memory alloy. In case the relative movement is regulated, as in the present invention, the compressive force upon the stopper member 108 is damped so that a preservatively treated woody material can be used for the stopper members 108, as the case may be.

In case, on the other hand, the stopper members 108 can be inserted from the side wall of the upper wedge-shaped pressure receiving member 101 or the wedge-shaped drive member 103 to regulate their movements, the aforementioned working space S is not unnecessary for inserting the stoppers 108 if there is left such a height between the lower structure and the bridge as can sandwich the upper wedge-shaped pressure receiving member 101 and the wedge-shaped drive member 103.

Figure 3:
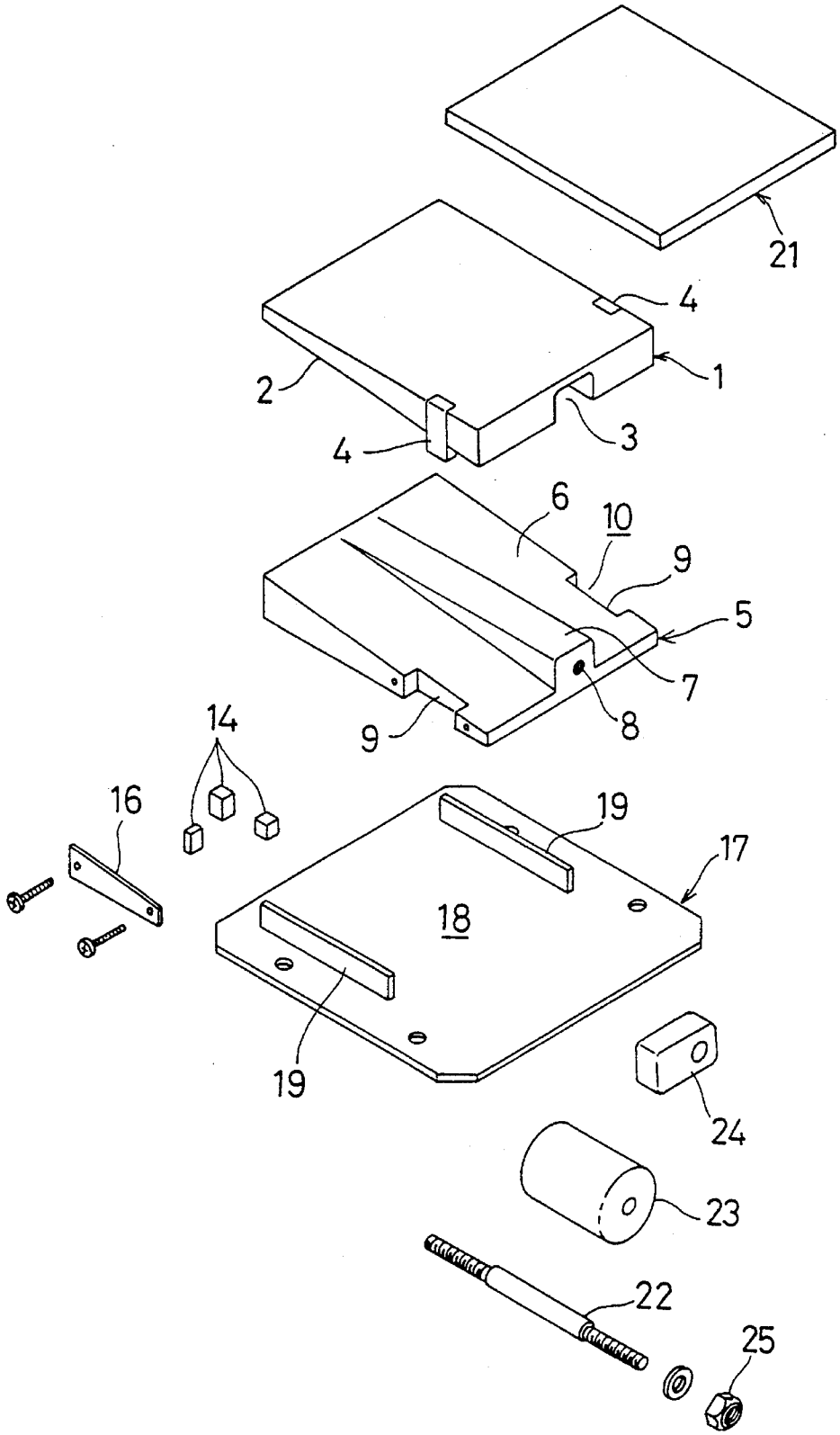
FIG. 3 is an exploded perspective view showing a bearing device according to a first embodiment of the present invention.
Figure 4:
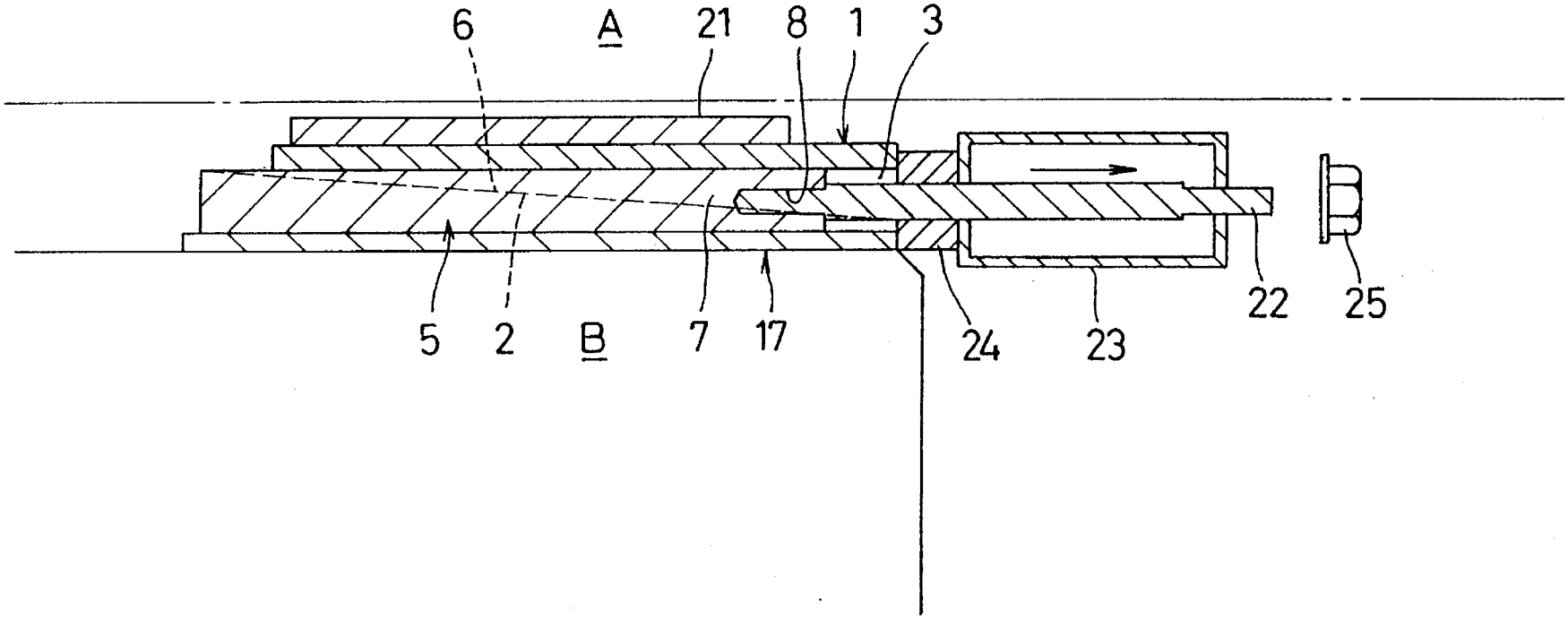
FIG. 4 is a vertical section showing a central portion of the bearing device of the same embodiment.

With reference to the drawings, here will be described the bridge bearing device using the aforementioned method directly. FIG. 3 is an exploded perspective view showing one embodiment of the bearing device according to the present invention, and FIG. 4 is a vertical section showing the central portion of the bearing device. Reference numeral 1 designates the upper wedge-shaped pressure receiving member which is made of a light and hard material such as a high polymer or titanium and formed into such a square top plan view as has a horizontal top face and a bottom face having its thickness gradually varied in the longitudinal (or sliding) direction to have a slope 2. This slope 2 is longitudinally formed in its entire length at its central portion between the two side walls with a groove 3 which has its bottom in parallel with the upper face to leave an equal thickness in the vertical section and its lower side opened. On the other hand, the upper wedge-shaped pressure receiving member 1 is formed with such sliding projections 4 at its side walls close to its front face other than the two ends, i.e., at the two sides closer to the thick portions, as shown, as have rectangular cross sections and have their leading ends positioned below the aforementioned slope 2. These sliding projections 4 may be molded integrally with the aforementioned upper wedge-shaped pressure receiving member 1, or the separate moldings may be fixed on the upper wedge-shaped pressure receiving member 1 by means of bolts, as shown.

In the present embodiment, the upper wedge-shaped pressure receiving member 1 is made of a laminate of special fibers impregnated with a fenolic resin. This laminate is made of a block: by impregnating a base of woven fabric of special fibers with a resin liquid, which is prepared by agitating phenol, formaldehyde and a special additive in a reaction vessel for reactions; by drying and cutting it into a predetermined size; and by laminating the cut bases and shaping the laminate by a shaping press. The block is mechanically worked into a predetermined shape and has its sliding faces treated with paraffin to make the upper wedge-shaped pressure receiving member 1. Here, the aforementioned material has physical properties such as a specific gravity of 1.39 and a hardness of 98 HRM. Moreover, the material has mechanical properties such as compression strengths of 25.3 $Kgf/mm^2$ in the laminating direction (as will be called the "vertical direction") and 14.9 $Kgf/mm^2$ in the direction along the woven fabric (as will be called the "horizontal direction"), bending strengths of 13.0 $Kgf/mm^2$ in the vertical direction and 14.3 $Kgf/mm^2$ in the horizontal direction, impact values of 45.2 $Kgf\cdot cm/cm^2$ in the vertical direction and 24.9 $Kgf\cdot cm/cm^2$ in the horizontal direction, and an abrasive wear of 0.02 mm/hr (under test conditions of a pressure $P=60\ Kg/cm^2$ and a sliding velocity V=1 m/s). Incidentally, these characteristic values are taken at a temperature of 20° C.

Moreover, reference numeral 5 designates a wedge-shaped drive member which is made of the same material as that of the aforementioned upper wedge-shaped pressure receiving member 1. This wedge-shaped drive member 5 is given such a square top plan shape as is formed on its upper face with a slope 6 having the same angle of slope for placing the slope 2 of the upper wedge-shaped pressure receiving member 1 in a sliding manner and as has a horizontal lower face so that it can move thereon in the longitudinal direction. This wedge-shaped drive member 5 is formed all over its length with such an upright ridge 7 in the longitudinal direction of the slope 6 at the central portion between its two side walls as can be substantially fitted in the aforementioned groove 3 and as has its upper edges in parallel with the lower face of the drive member 5 and at the equal height from the same lower face in its vertical section. Moreover, the ridge 7 is formed generally at its longitudinal center with a mounting hole or threaded hole 8 for fixing the sliding rod of a later-described hydraulic center hole jack.

Still moreover, the wedge-shaped drive member 5 is formed with longitudinal guide portions 9 by notching its two side walls at the portions including the side walls and the edges of the slope 6 closer to the front excepting the two ends, that is, closer to the thin side, as shown. The guide portions 9 should not be limited to the through grooves having their upper and lower ends opened, as shown, but may be exemplified by bottomed grooves. The guide portions 9 to be adopted may be any if they can fit the aforementioned sliding projections 4 to allow the same to move in their longitudinal direction. Since the guide portions 9 are formed by notching at least the side walls and the ridges of the slope 6, as in the present embodiment, the positional relation between the guide portions 9 and the sliding projections 4 can be visually confirmed from the side walls of the wedge-shaped drive member 5 even if the upper wedge-shaped pressure receiving member 1 and the wedge-shaped drive member 5 are in their jointed state.

Figure 5:
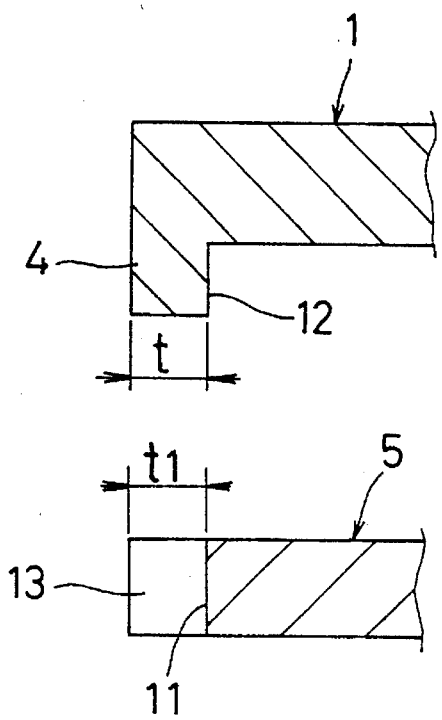
FIG. 5 is an end view showing a guide portion of the same bearing device.
Figure 6:
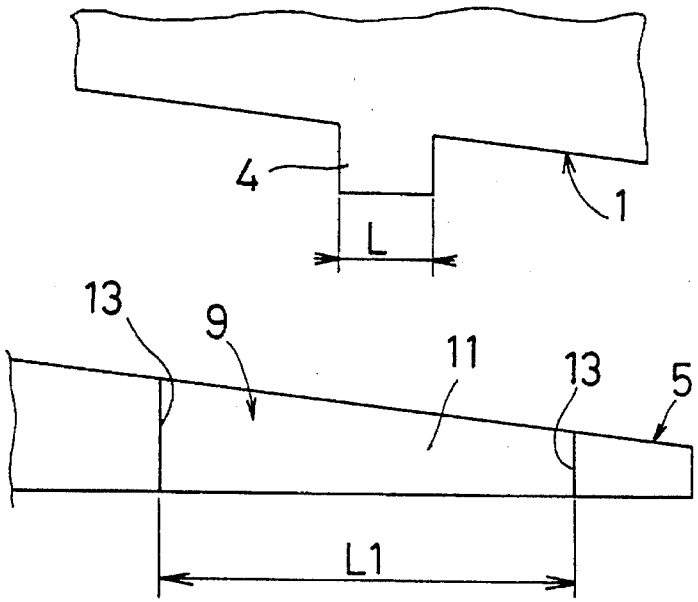
FIG. 6 is a side elevation showing the guide portion of the same bearing device.

The sliding projections 4 and guide portions 9 described above constitute an engaging portion 10 and have specific size relations, as shown in FIGS. 5 and 6, of which FIG. 5 is a vertical end section showing a portion of the engaging portion 10, as taken in the longitudinal direction, and FIG. 6 is a side elevation showing a portion, as taken in the direction of the side wall. Specifically, the sliding projection 4 can be used, if its thickness t is smaller than two or less times of the width $t_1$ of the shorter side walls 13 in the guide portions 9 while the longer side walls 11 in the guide portions 9 are abutting against the inner side walls 12 of the sliding projections 4. Considering the safety, it is desired that $t \leqq t_1$. On the other hand, the relation between the lengths of the sliding projections 4 and the guide portions 9 are naturally required, as shown in FIG. 6, to satisfy that the length $L_1$ of the longer side walls 11 be longer than the length L of the sliding projections 4, because the sliding projections 4 are positioned in the guide portions 9. With this relation, the sliding projections 4 can be moved in the guide portions 9. The range for allowing the projections 4 to move in the guide portions 9 is determined by the difference of the length $L_1$ of the longer side walls 11 from the length L of the projections 4. However, this moving distance can be suitably set to retain the necessary rise by considering the length of the aforementioned upper wedge-shaped pressure receiving member 1 or wedge-shaped drive member 5 and the angle of the slopes 2 and 6.

The sliding projections 4 and guide portions 9 thus set act, as shown in FIGS. 1 and 2. Moreover, covers, as designated at 16 in FIG. 3, are desirably attached to the aforementioned stopper members 14 after these members 14 have been fitted in spaces 15, so that the stopper members 14 may be prevented from coming out. This is because the stopper members 14 will easily come out sideways, till the sliding projections 4 are moved in the opposite direction to the raising time relative to the guide portions 9 by the horizontal load due to the vibrations and extensions or contractions of the bridge so that they come into abutment to apply the compressive load to the stopper members 14, although the upper wedge-shaped pressure receiving member 1 and the wedge-shaped drive member 5 are not moved merely by the static vertical load of the bridge because of a high stationary frictional resistance between the slopes 2 and 6 even if the pulling drive force applied to the wedge-shaped drive member 5 is removed after the stopper members 14 are fitted. Once the compressive load is naturally or manually applied to the stopper members 14 by the sliding projections 4, the stopper members 14 are hard to come out sideways, but this safety is ensured if the aforementioned covers 16 are provided.

Figure 7:
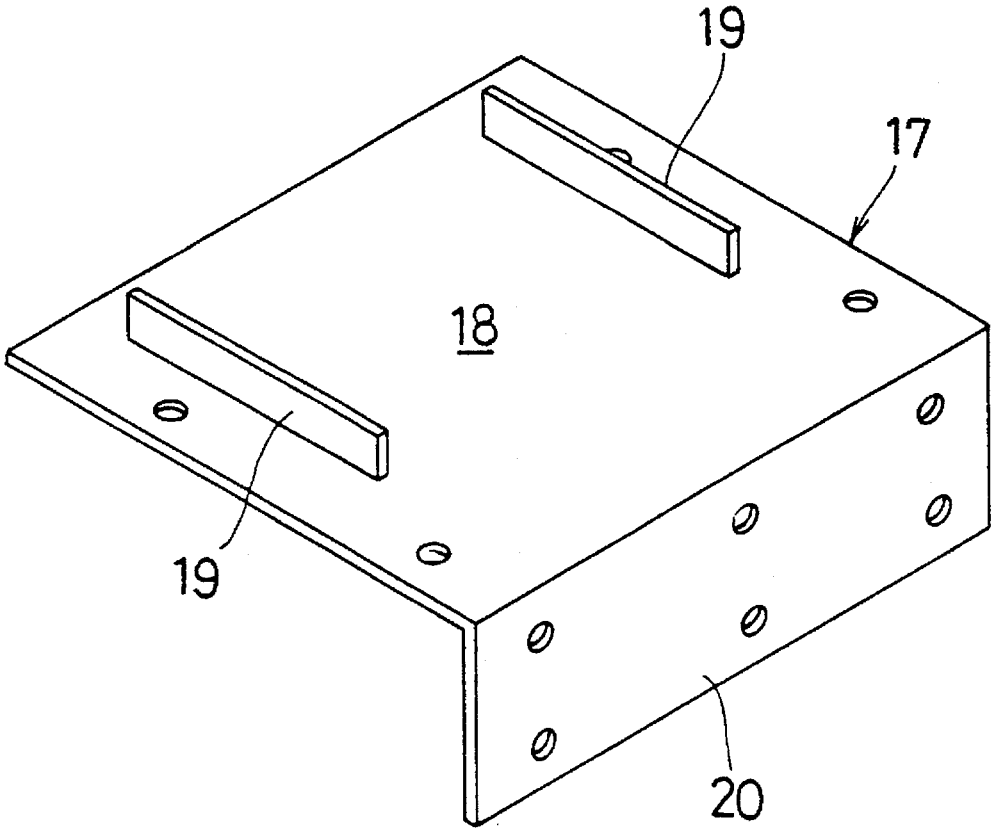
FIG. 7 is a perspective showing another embodiment of a base plate of the same bearing device.

Reference numeral 17 designates a base plate which is formed on its upper face with a sliding face 18 for sliding the aforementioned wedge-shaped drive member 5 and at the two sides of the sliding face 18 with position regulating members 19 for allowing the wedge-shaped drive member 5 to move only in the longitudinal direction. The base plate 17 is used to reduce the frictional resistance between the wedge-shaped drive member 5 and the mounting face of the lower structure. The base plate 17 to be used is made of a stainless steel plate having a low frictional resistance or a plate of another metal or a hard resin and is prepared by polishing or similarly working only the sliding face 18. Moreover, the aforementioned position regulating members 19 can be prepared by fixing parallel plates on the sliding face 18 at a distance equal to the width of the wedge-shaped drive member 5, as shown. Incidentally, the position regulating members 19 may be able to regulate the movement of the wedge-shaped drive member 5 only in the longitudinal direction and may be exemplified by forming recesses or ridges in the longitudinal direction in or on the lower face of the wedge-shaped drive member 5 and by forming the corresponding ridges or recesses on or in the aforementioned base plate 17, as will be described hereinafter. Moreover, the base plate 17 is laid below the wedge-shaped drive member 5 and is fixed on the lower structure such as the bridge by the known fixing means such as bolts. In case there is no working space above the base plate 17, for example, the base plate 17 may be molded to have a fixing plate 20 extending downward from its front edge, as shown in FIG. 7. Then, the base plate 17 can be fixed by fixing its fixing plate 20 on the side wall of the lower structure. Incidentally, the base plate 17 can have its position adjusted according to the gap between the upper face of the lower structure and the lower face of the bridge by the known means either for sandwiching a plate member for adjusting the height between the upper face of the lower structure and the base plate 17 or for cutting the upper face of the lower structure.

Moreover, reference numeral 21 designates a plate-shaped shoe making one of the most important components of the bearing device. The plate-shaped shoe 21 is placed on the aforementioned upper wedge-shaped pressure receiving member 1 and is made of hard rubber or the like. The shoe 21 may be exemplified by the conventional shoe such as the roller type shoe as well as the shown plate-shaped shoe 21, but this shoe 21 requires no large height and is suitable because the present embodiment assumes the case in which the sandwiching gap is the smallest. As the case may be, moreover, a slidable plate made of stainless steel or polytetrafluoroethylene (PTFE) may be sandwiched on the abutting face between the plate-shaped shoe 21 and the upper wedge-shaped pressure receiving member 1 so that the plate-shaped shoe 21 itself may slide, as will be embodied hereinafter.

Figure 8:
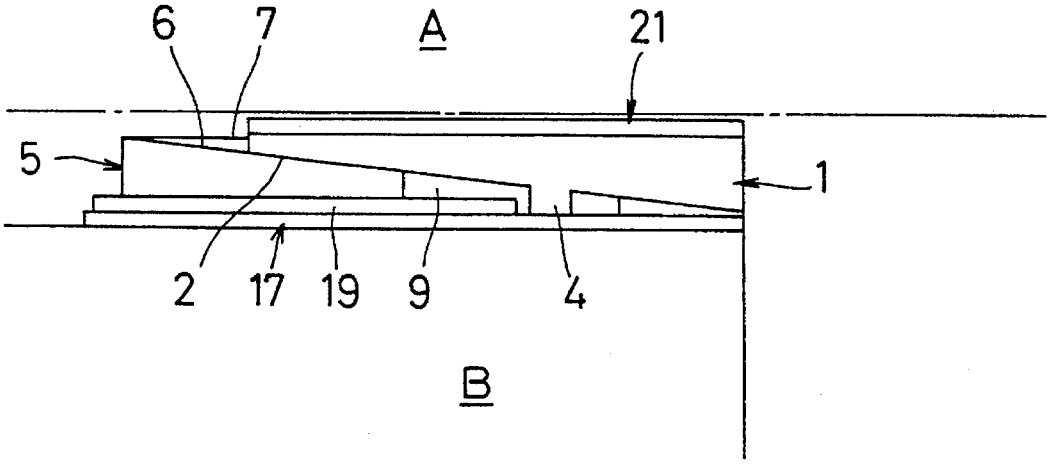
FIG. 8 is a side elevation showing the state in which the bearing device is sandwiched between a lower structure and a bridge.

An example of using the bearing device thus constructed according to the present invention is shown in FIGS. 8 to 11. First of all, the aforementioned base plate 17 is fixed on the upper face of the lower structure B in the vicinity of the existing bearing by the known means such as bolts. If, at this time, the upper face of the lower structure B is not horizontal, the upper face of the base plate 17 is made horizontal by sandwiching the not-shown plate or the like between the base plate 17 and the lower structure B. Then, the wedge-shaped drive member 5 is placed on the sliding base 18 of the base plate 17 between the aforementioned position regulating members 19. Incidentally, since the present embodiment employs the hydraulic center hole jack as the means for moving the wedge-shaped drive member 5, the attaching work of the center hole jack is facilitated by fixing one end of the sliding rod of the jack in advance to the wedge-shaped drive member 5. Then, the upper wedge-shaped pressure receiving member 1 is placed, while having its sliding projections 4 fitted in the guide portions 9 of the wedge-shaped drive member 5, until their slopes 2 and 6 come into abutment against each other. At this time, the ridge 7 is naturally fitted in the groove 3 so that the upper wedge-shaped pressure receiving member 1 is regulated in its widthwise movement, and the plate-shaped shoe 21 is placed on the upper wedge-shaped pressure receiving member 1. These series of works may be accomplished either sequentially or all at once in the previously stacked state. In this initially set state, the upper wedge-shaped pressure receiving member 1 and the wedge-shaped drive member 5 are so displaced to have their thin portions abutting against each other that the plate-shaped shoe 21 may take the minimum height, as shown in FIG. 8. In this initially set state, the upper edges of the ridge 7 and the bottom of the groove 3 are in the narrowest or contacting state but they don't receive the concentration of load because their gap is increased as the wedge-shaped drive member 5 is thereafter moved.

Figure 9:
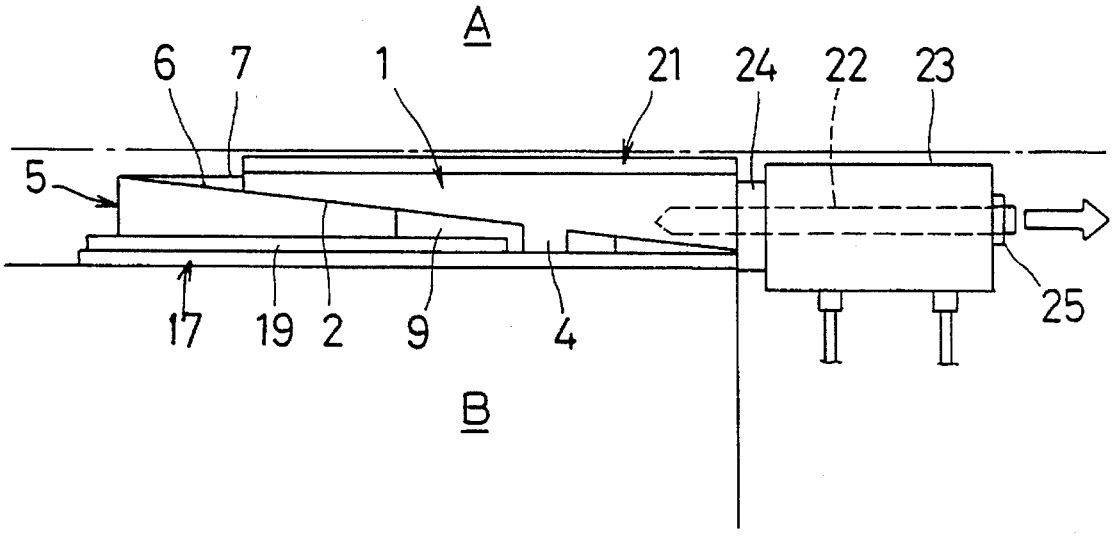
FIG. 9 is a side elevation showing the state in which a jack is attached to the bearing device.

Next, the aforementioned hydraulic center hole jack is attached to the wedge-shaped drive member 5 by fixing one end of its sliding rod 22 to the front face of the wedge-shaped drive member 5 through the mounting hole 8, either by bringing a jack body 23 into abutment against the front face of the base plate 17 and the front face of the upper wedge-shaped pressure receiving member 1 or by bringing a reaction receiving member 24 formed with a through hole capable of inserting the sliding rod 22, in place of the jack body 23, into those front faces and the jack body 23, by inserting the sliding rod 22 into the jack body 23, and by fixing the hydraulic center hole jack by a non-return nut 25 or the like, as shown in FIG. 9.

Figure 10:
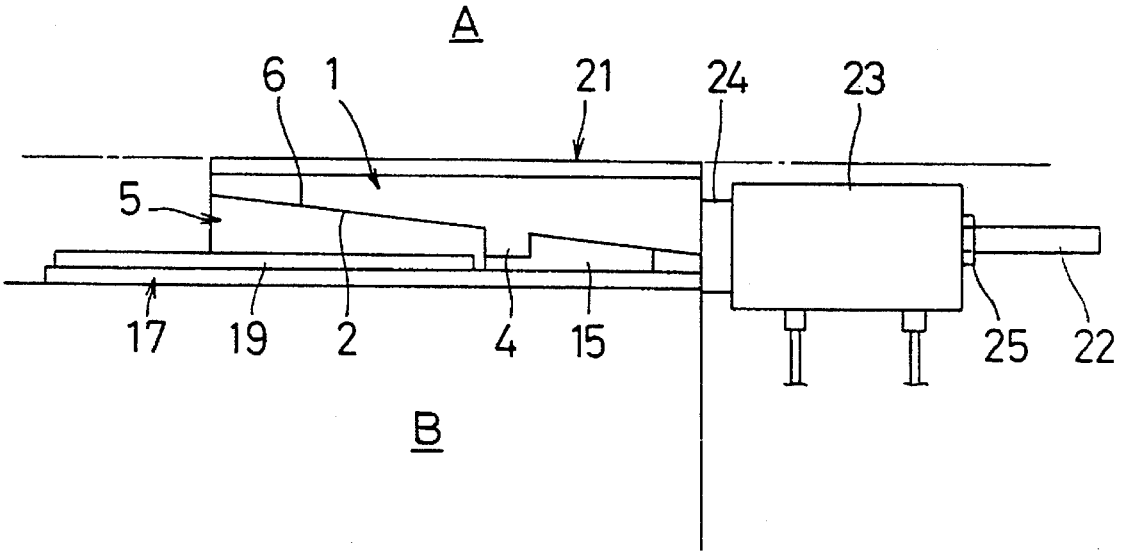
FIG. 10 is a side elevation showing the state in which the bridge is raised by the bearing device.

Thus, when the jack is driven, the sliding rod 22 is moved rightwards of the drawing, and the wedge-shaped drive member 5 is accordingly slid on the sliding face 18 of the base plate 17 toward the jack so that the upper wedge-shaped pressure receiving member 1 begins to rise along the slope 6 of the wedge-shaped drive member 5 and the slope 2 of the upper wedge-shaped pressure receiving member 1. Before long, the plate-shaped shoe 21 on the upper wedge-shaped pressure receiving member 1 comes into abutment against the lower face of the bridge or the like to raise it. In this meanwhile, the projections 4 slide in the aforementioned guide portions 9 to establish the spaces 15 from the initial positions to the slid positions of the projections, as shown in FIG. 10.

Figure 11:
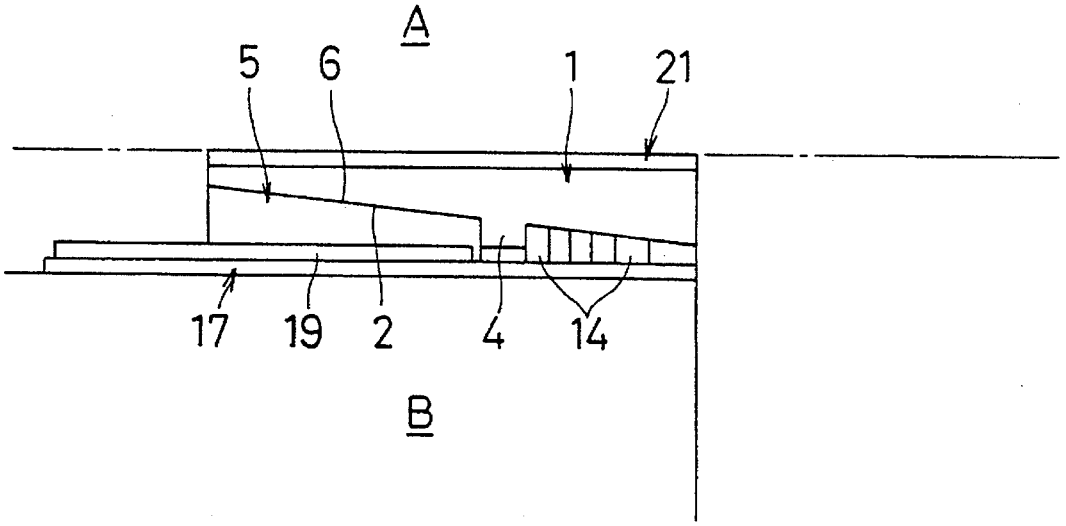
FIG. 11 is a side elevation showing the state in which the bridge is supported in a raised position by the bearing device with the jack being removed.

Moreover, when the bridge or the like is raised to a suitable position, the raising operation is interrupted by adjusting the jacking force, and the aforementioned sliding projections 4 are completely prevented from returning, by fitting one or more stopper members 14 in the spaces 15 of the guide portions 9 while the rod 22 is temporarily regulated from its return by fastening the non-return nut 25 or while the jacking force is held at a predetermined level. This state is shown in FIG. 11.

Even if the aforementioned jacking force is reduced to zero after the rise has thus been maintained, the upper wedge-shaped pressure receiving member 1 and the wedge-shaped drive member 5 usually make no movement relative to each other with only the static vertical load to be exerted upon the present device from the bridge or the like. If, however, a horizontal load is established by a cause such as the vibrations and extensions or contractions of the bridge, the sliding projections 4 are going to move in the opposite direction to the aforementioned one but have their movements regulated by the aforementioned stopper members 14 so that they cannot not return. As a result, the bridge or the like is not lowered from but held in the raised position. By that load, moreover, the stopper members 14 are compressed and prevented from coming out. When the aforementioned jack is finally removed in the reverse procedure from the wedge-shaped drive member 5, the present device is left alone and can be used as it is for the bearing device. Incidentally, the aforementioned drive means should not be limited to the center hole jack device but can naturally be exemplified by any such as an ordinary hydraulic jack device if it can move the upper wedge-shaped pressure receiving member 1 or the wedge-shaped drive member 5 in the longitudinal directions.

Figure 12:
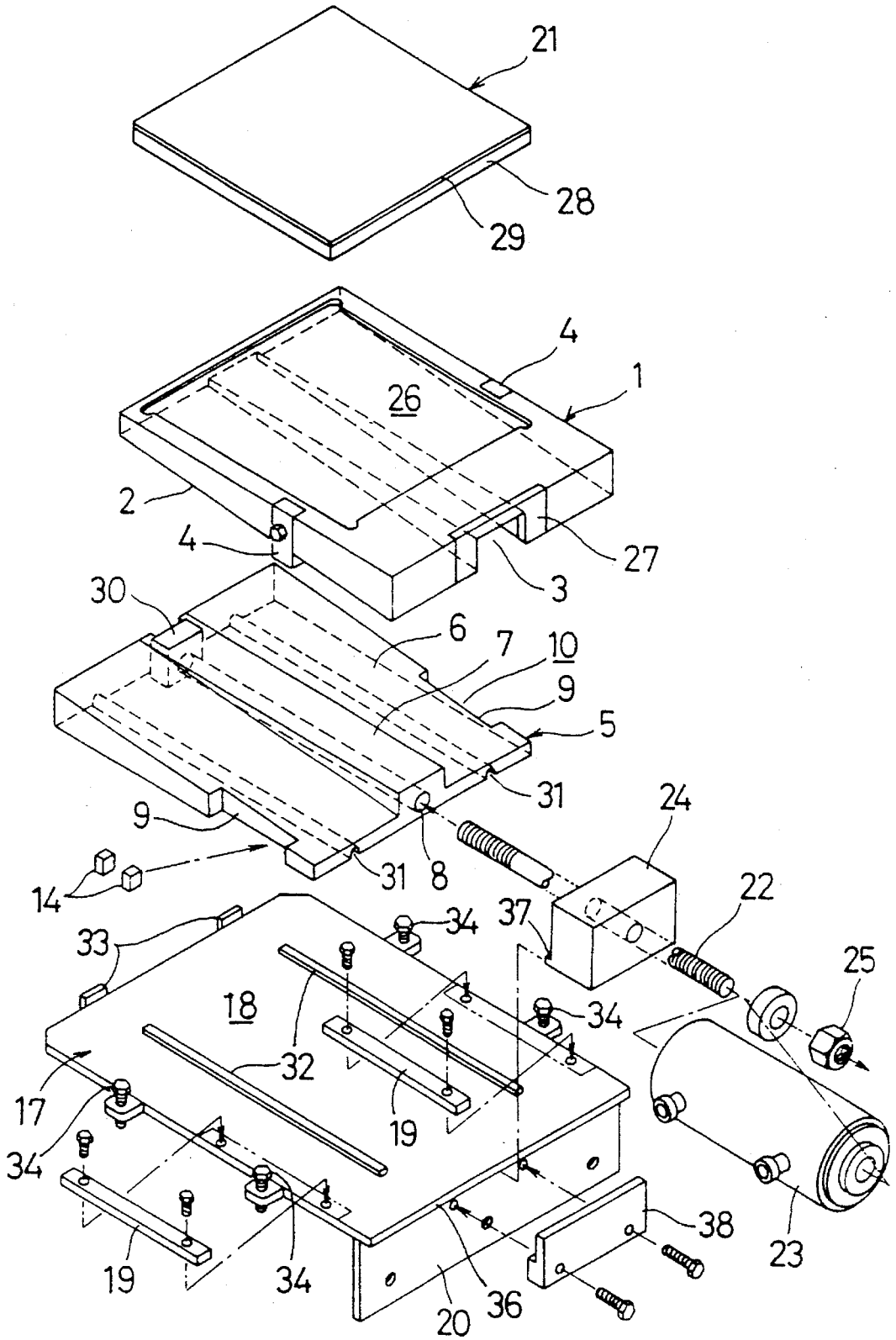
FIG. 12 is an exploded perspective view showing a second embodiment of the bearing device of the present invention.

Here will be described a second embodiment of the present invention with reference to FIGS. 12 to 14. Since the basic construction of the present embodiment is similar to that of the foregoing embodiment, the identical components are designated at the same reference numerals, and their detailed description will be omitted. The present embodiment is featured by improving the earthquake-proof so that the bearing device may be used for a long time and by allowing a horizontal movement between the upper wedge-shaped pressure receiving member 1 hardly influenced by the sediment and the lower face of a bridge A.

The upper wedge-shaped pressure receiving member 1 is formed in its upper face with a recessed portion 26 while leaving its periphery so as to fit the lower portion of the plate-shaped shoe 21 therein without any transverse displacement and is buried with a metallic reinforcing member 27 in the end face of its thick portion including the end portion of the aforementioned groove 3 and at its portion to press-fit the aforementioned reaction receiving member 24. Here, the plate-shaped shoe 21 is exemplified by a rubber pad 28, which is used in the prior art as the rubber bearing for the bridge and is prepared by burying a reinforcing member of stainless steel in the chloroprene rubber base, and is formed on its upper face with a slide layer 29 made of PTFE for improving the sliding property.

The wedge-shaped drive member 5 is formed in the aforementioned ridge 7 with the mounting hole 8 extending therethrough from the thin to thick portions and is buried in the end of its thick portion with a square receiving nut 30 for receiving and fastening the leading end of the sliding rod 22 inserted into the mounting hole 8 from the thin portion. Moreover, the wedge-shaped drive member 5 is formed in the two side portions of its lower face with grooves 31 and 31 which extend through the drive member 5 in parallel with the ridge 7.

The base plate 17 is formed, on its upper sliding face 18 and at positions corresponding to the aforementioned grooves 31 and 31, with a pair of elongated parallel ridges 32 and 32 to be fitted in the grooves 31 and 31, and the fixing plate 20 is fixed to the lower face of the front side of the base plate 17 while leaving a distance corresponding to the plate thickness at the end edge. These grooves 31 and ridges 32 are provided for preventing the wedge-shaped drive member 5 from being transversely moved or twisted with respect to the base plate 17, thereby to ensure smooth longitudinal movements of the wedge-shaped drive member 5. Moreover, the base plate 17 is provided at its rear face, i.e., at the opposite end edge to the fixing plate 20 with abutting stoppers 33 for preventing the wedge-shaped drive member 5 from dropping back. Furthermore, the position regulating members 19 can be fixed by means of bolts on the two sides of the sliding face 18 closer to the front side of the base plate 17. The bridge A is raised, and the stopper members 14 are fitted in the guide portions 9. After this, the position regulating members 19 and 19 are fixed on the base plate 17 to regulate the transverse movements of the wedge-shaped drive member 5 reliably while improving the earthquake-proof and to preventing the stopper members 14 from coming out sideways. Thus, the aforementioned covers 16 can be dispensed with. Moreover, the base plate 17 is provided at the front and rear portions of its two side edges with adjusters 34 for leveling the base plate 17.

On the other hand, the reaction receiving member 24 of the present embodiment is formed, on the lower edge of its flat flat face to abut against the reinforcing member 27 of the upper wedge-shaped pressure receiving member 1, with a projecting edge 37 to engage with the lower face of a front end edge 36 of the aforementioned base plate 17, thereby to prevent the reaction receiving member 24 from incidentally rising. The aforementioned fixing plate 20 is formed with threaded holes in its predetermined positions so that an adjusting member 38 may be so fastened after the rise by bolts to the corresponding portion of the base plate 17 with the reaction receiving member being removed as to confront the aforementioned abutting stoppers 33.

Figure 13:
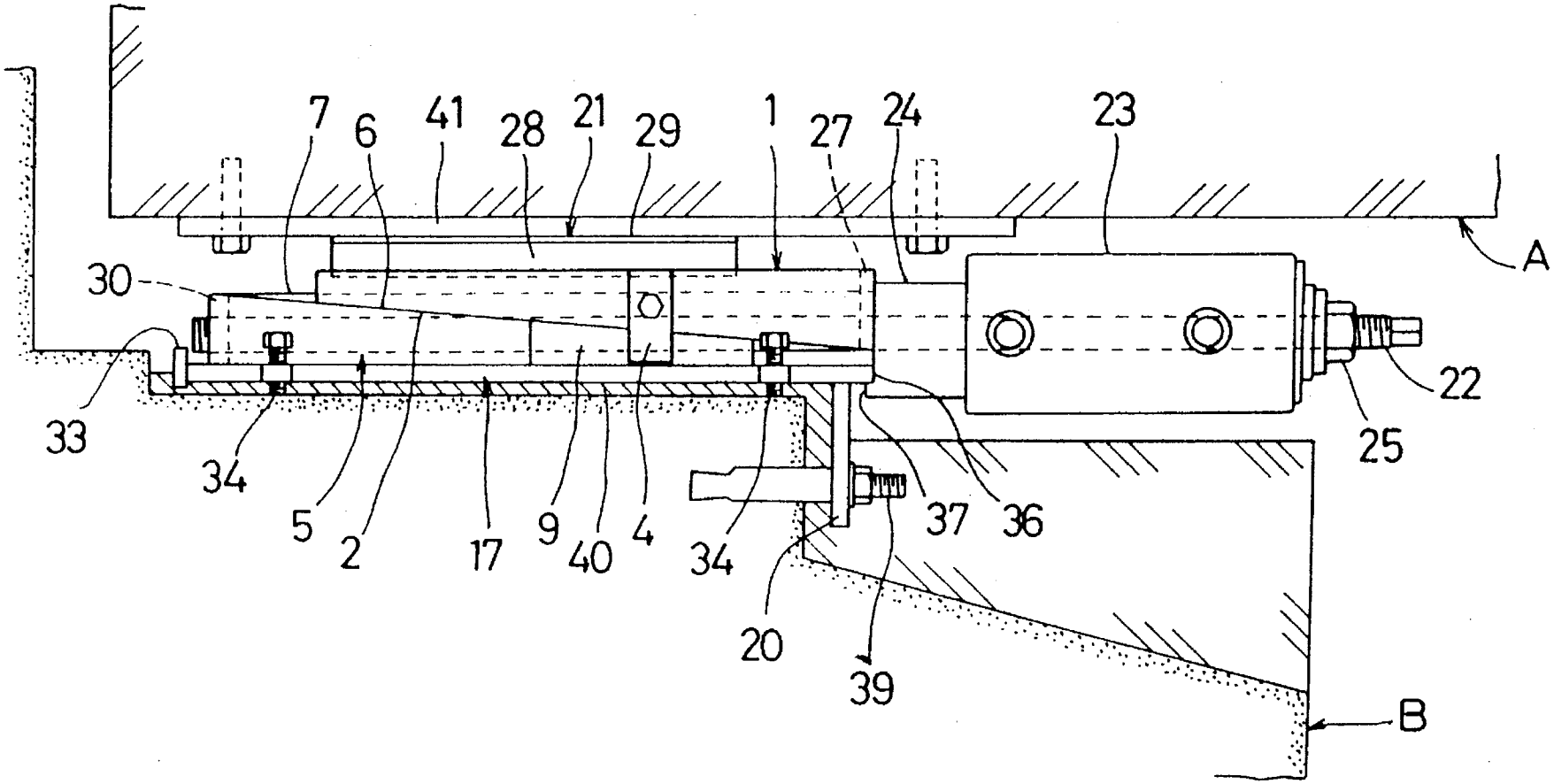
FIG. 13 is a partially broken side elevation showing the state in which the same bearing device with a jack is sandwiched between a lower structure and a bridge.

As shown in FIG. 13, moreover, the lower structure B to mount the base plate 17 is partially removed in advance by means of a drill or the like, and the level of the base plate 17 is adjusted by using the adjusters 34. After this, the fixing plate 20 is fixed on the side wall of the lower structure B by means of anchor bolts 39, and cement mortar 40 is placed below the lower face or the like of the base plate 17 thereby to fix the base plate 17 completely on the lower structure B. Before placing the cement mortar 40, moreover, reinforcing bars are welded, if necessary, to the existing reinforcement. Incidentally, the graft of cement can be injected, if the gap between the lower structure B and the base plate 17 is about 15 mm or more, but otherwise a resin graft is injected. On the bridge A, on the other hand, there is fixed an upper shoe 41 which is made of a strong and excellently sliding material such as stainless steel to have a sliding lower face. In case the upper shoe 41 is to be fixed, the unevenness of the lower face of the bridge A is corrected, and the upper shoe 41 is then fixed by the suitable fixing means such as anchor bolts. After this, the wedge-shaped drive member 5, the upper wedge-shaped pressure receiving member 1 and the plate-shaped shoe 21 are stacked on the base plate 17 like the foregoing embodiment, and the sliding rod 22 is fastened to the wedge-shaped drive member 5 and is attached to the center hole jack (or jack body 23).

In case the existing bearing is broken so that the bridge A sinks over the designed value thereby to disable the existing bearing to be removed, the bridge A is raised to a predetermined level by the present device, and the stopper members 14 are fitted so that the present device may be used as a new bearing device. In case, on the other hand, the existing bearing retains its function, although insufficient, but cannot be removed, the bridge A is raised to such an extent by the present device as to invite no change in the level and to introduce a reaction, and the stopper members 14 are fitted like before so that the present device may be juxtaposed to the existing bearing and used as a new bearing device thereby to share the load acting upon the existing bearing.

Figure 14:
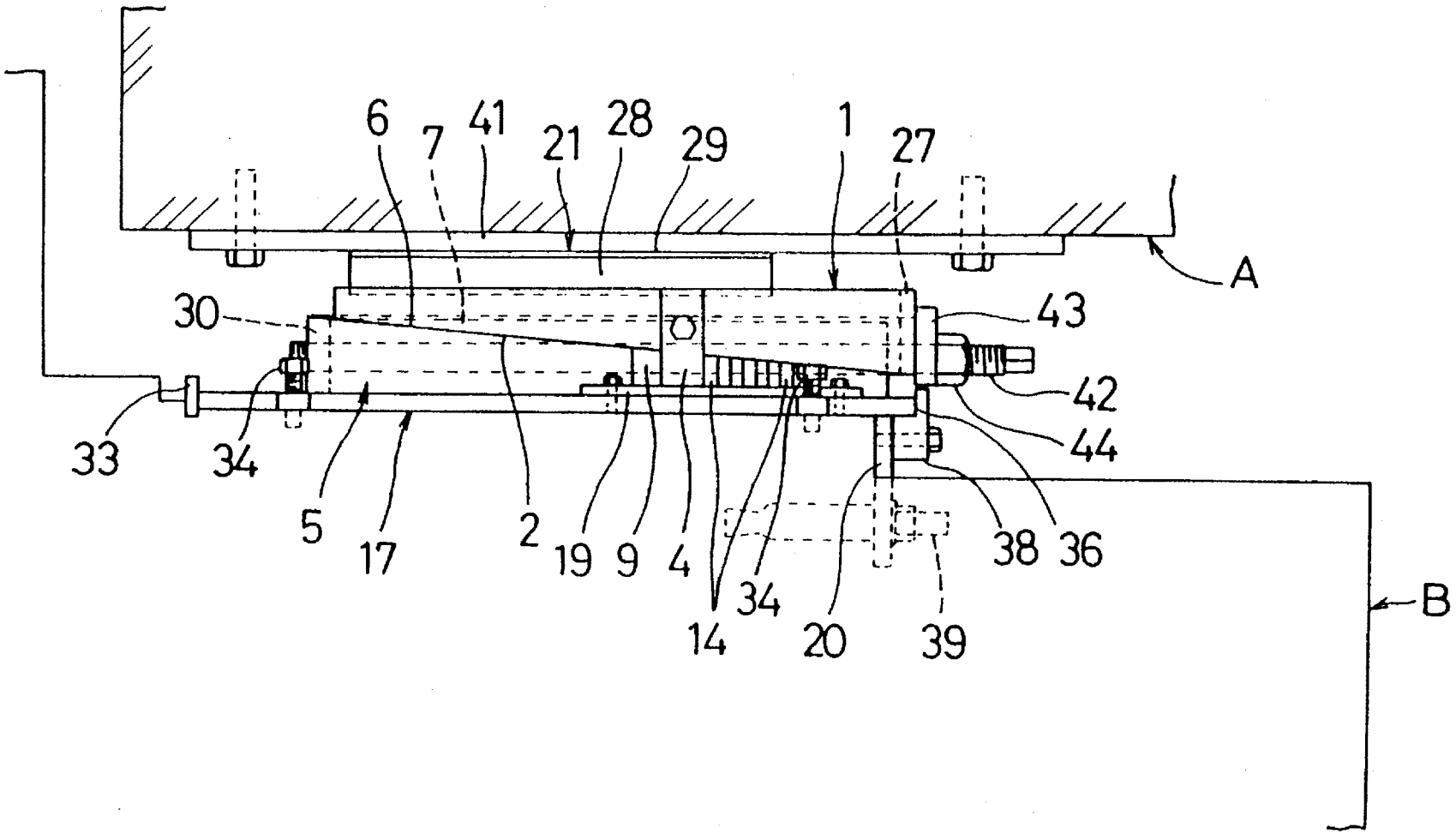
FIG. 14 is a side elevation showing the state in which the bridge is raised and supported by the same bearing device.
Figure 15:
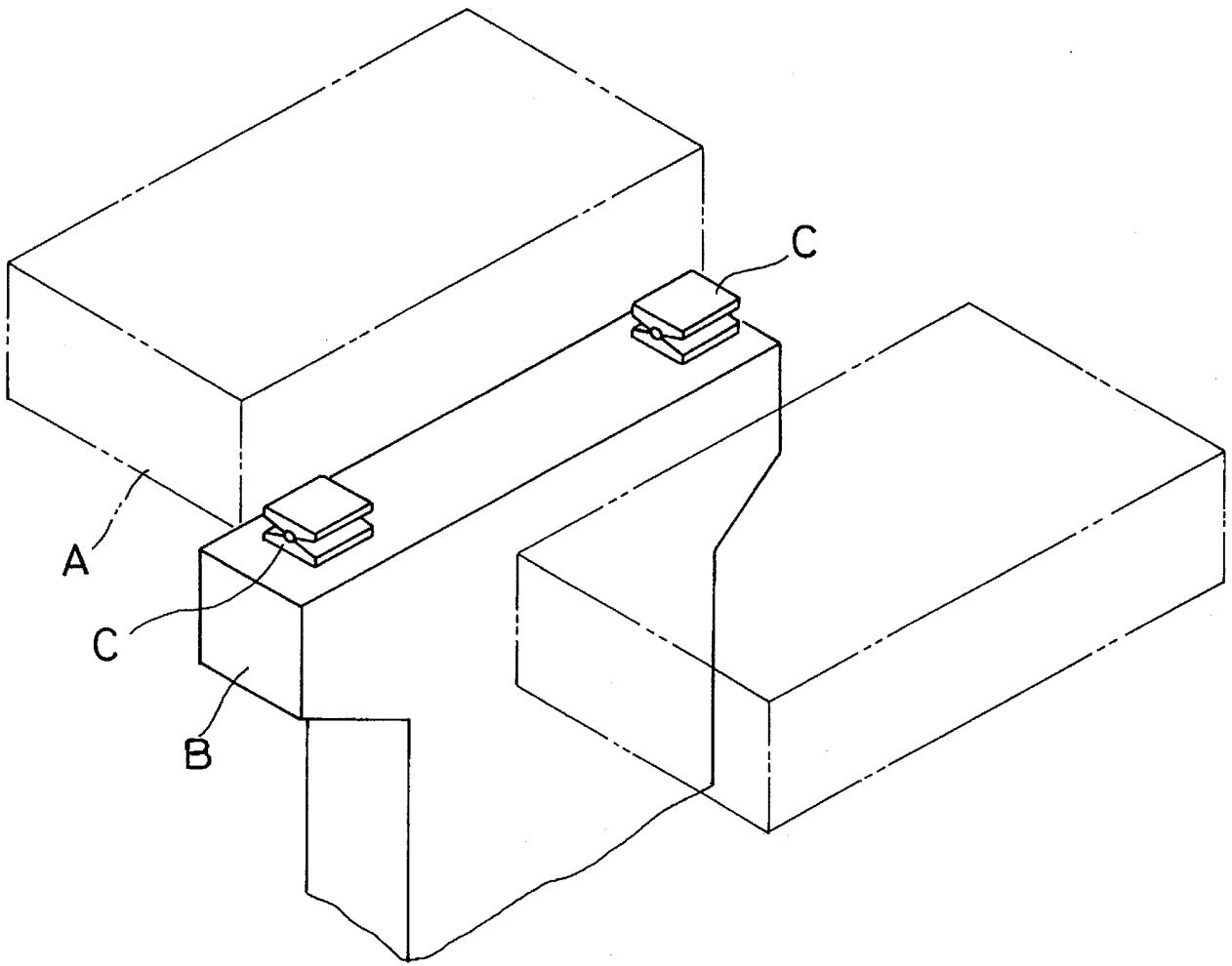
FIG. 15 PRIOR ART
FIG. 15 is a perspective view showing the used state of the existing bearings.
Figure 16:
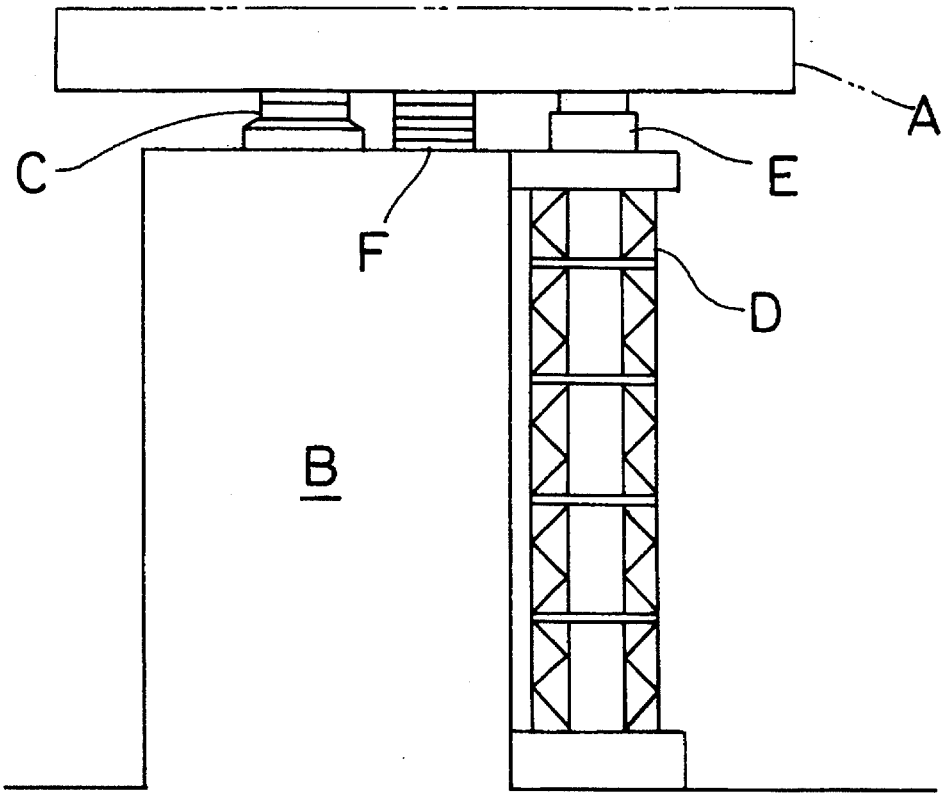
FIG. 16 PRIOR ART
FIG. 16 is an explanatory diagram showing one example of the method and device of the prior art.

FIG. 14 shows the state in which the present device is used as the bearing device. In this state, the stopper members 14 are fitted in the guide portions 9 to regulate the relative movements of the upper wedge-shaped pressure receiving member 1 and the wedge-shaped drive member 5, and the position regulating members 19 and 19 are fixed on the side portions of the stopper members 14 to regulate the transverse movement of the wedge-shaped drive member 5 and to prevent the stopper members 14 from transversely coming out. Moreover, after the stopper members 14 have been fitted, the sliding rod 22 is removed and replaced by a shorter tension bar 42. This tension bar 42 has its one end fastened in the aforementioned receiving nut 30 and its other end fastened through a washer 43 by a nut 44 thereby to integrate the upper wedge-shaped pressure receiving member 1 and the wedge-shaped drive member 5 completely. Moreover, the adjusting member 38 is attached to the fixing plate 20 so that it prevents, with the aforementioned abutting stoppers 33, the wedge-shaped drive member 5 from moving back and forth with respect to the base plate 17 and coming out from the base plate 17. Moreover, the horizontal displacement due to the vibrations and extensions or contractions of the bridge A is absorbed by the sliding movements of the slide layer 29 of the plate-shaped shoe 21 and the lower face of the upper shoe 41. Here, the sliding face 18 of the aforementioned base plate 17 and the lower face of the wedge-shaped drive member 5 have their surfaces treated so that the wedge-shaped drive member 5 may be easily moved at the raising time. If the frictional resistance between the slide layer 29 of the plate-shaped shoe 21 and the lower face of the upper shoe 29 is less, the wedge-shaped drive member 5 is not moved with respect to the base plate 17. As a result, the bearing device does not have its function deteriorated even if the base plate 17 and the wedge-shaped drive member 5 are buried with the deposition.

As has been described hereinbefore, the present invention has the prominent effects that a new bearing device can be set without removing the bridge itself even if there is no working space for removing the existing bearing, and that the bridge can have its level restored to the original value desired at its construction time even its level is lowered from the its original value due to loss of the existing bearing. Since, moreover, the bearing itself raises the bridge and is set as it is as the new bearing device, the bearing can be replaced with neither stopping the traffic of vehicles or the like to run thereon nor regulating the vehicular traffic during the term of works. Since, still moreover, the wedge-shaped drive member used has the slope on its one face, it requires a less height than that of the wedge-shaped drive member having two sloped faces so that it can find suitable applications to the works in a narrower gap. Incidentally, it is quite natural that the wedge-shaped drive member having the two slopes can be used depending upon the size of the gap.

Moreover, the bearing device of the present invention uses the individually separable components including the wedge-shaped drive member, the upper wedge-shaped pressure receiving member, the base plate and the hydraulic jack, that is to say, these components are not integrated unlike those of the existing bearing of the prior art. As a result, the bearing device of the present invention can be easily assembled in the working side and can be safely and easily transported even to a high working side to shorten the term of works. After the bridge or the like has been raised, still moreover, the hydraulic jack (or the drive means) can be removed and likewise used in another working site so that the expensive hydraulic jack can be reused many times to lower the cost drastically. Especially if the hydraulic center hole jack is used, the sliding rod is extended through the jack and connected to the drive portion of the jack by having its leading end connected to the front face of the wedge-shaped drive member and its other end fastened by the non-return nut, so that the raising operation is carried out by pulling the wedge-shaped drive member toward the jack body in accordance with the operation of the drive portion of the jack. As a result, the jack body can be easily removed because it need not be fixed in the least. If, moreover, the jack body is short of stroke, it is enabled to pull the wedge-shaped drive member again by returning the drive portion to the initial state and further fastening the non-return nut. As a result, the jack body can be made small in size and weight and easy to handle.

In case, on the other hand, only the wedge-shaped drive member has its movement regulated as in the prior art, its return regulating force is directly received by the reaction receiving plate so that the mounting strength of the reaction receiving plate is essential for preventing the return of the wedge-shaped drive member and is not suitable for a long use. In the present invention, however, the stopper member or members are fitted in the spaces to effect the self-complete regulation of mutual movements between the upper wedge-shaped pressure receiving member and the wedge-shaped drive member, so that the pressure receiving plate can be eliminated to simplify the structure. Since, moreover, the compressive load is applied to the stopper members, these members can be freed from coming out if made of a material enduring that load so that they can be used for a long time.

In case, moreover, the plate-shaped shoe of hard rubber or the like has its lower portion in the recessed portion formed in the upper face of the upper wedge-shaped pressure receiving member and in case the upper shoe attached to the lower face of the bridge or the like is slidably placed on the plate-shaped shoe, the vibrations and extensions or contractions of the bridge or the like can be absorbed by the plate-shaped shoe and the upper shoe which are so positioned above the upper wedge-shaped pressure receiving member as to be hardly buried with the deposit of earth or sand, even if the earth or sand deposits on the lower structure to disable the base plate and the wedge-shaped drive member to move relative to each other, so that the bearing device can be used for a long time. Since the plate-shaped shoe is formed with the slide layer on at least its upper face, the sliding movements between the plate-shaped shoe and the upper shoe attached to the bridge or the like can be better smoothened.

What is claimed is:

1. A method of raising/supporting a bridge on a lower structure, comprising the steps of:

sliding an upper wedge-shaped pressure receiving member having a slope on its lower face and a wedge-shaped drive member having a slope on its upper face relative to each other on their slopes by drive means for driving said wedge-shaped drive member, to raise an upper face of said upper wedge-shaped pressure receiving member with respect to said lower structure, regulating said upper wedge-shaped pressure receiving member and said wedge-shaped drive member, restraining relative movements between said wedge-shaped drive member and said upper wedge-shaped pressure receiving member with one or more stopper members after said bridge has been raised, and removing said drive means after the regulation of the relative movements of said upper wedge-shaped pressure receiving member and said wedge-shaped drive member.

2. A bridge raising/supporting method according to claim 1, wherein said step of regulating includes providing means for effecting movement regulation which includes:

projections formed on one of said upper wedge-shaped pressure receiving member and said wedge-shaped drive member and projected toward the other member; guide portions formed in said other member and sized to slidably receive said projections; and wherein said one or more stopper members are fitted in one or more spaces left in said guide portions after sliding said projections in said guide portions.

3. A bridge raising/supporting method according to claim 2, further including fitting said one or more stopper members in said guide portions from side walls of said upper wedge-shaped pressure receiving member or said wedge-shaped drive member to restrain the relative movements of said two members.

4. A bridge raising/supporting method according to claim 1, further including providing said drive means with: a hydraulic center hole jack; and a sliding rod extending through said jack and having one end connected removably to said wedge-shaped drive member and an other end associated with a drive portion of said jack.

5. A bridge raising/supporting method according to claim 1, further including sandwiching a plate-shaped shoe between said upper wedge-shaped pressure receiving member and a lower face of said bridge so that said upper shoe and said plate-shaped shoe may slide on contacting faces, whereby displacement due to vibrations and extensions or contractions of said bridge is absorbed.

6. A device for bearing a bridge, comprising:

an upper wedge-shaped pressure receiving member having side walls, a lower face forming a slope, and edges between the side walls and the slope;

a wedge-shaped drive member having side walls, an upper face forming a slope, and edges between the side walls and the slope, said drive member having a sloping angle equal to a sloping angle of said pressure receiving member to slide on the slope of said upper wedge-shaped pressure receiving member and said drive member being adapted to be pushed and pulled in a longitudinal direction;

engaging portions including guide portions formed in one of said upper wedge-shaped pressure receiving member and said wedge-shaped drive member by notching said edges in the longitudinal direction and sliding projections formed in the other of said upper wedge-shaped pressure receiving member and said wedge-shaped drive member and sized to move said guide portions only in said longitudinal direction; and stopper members adapted to be fitted in spaces which are left in said guide portions after said sliding projections have moved in the longitudinal direction.

7. A bridge bearing device according to claim 6, further comprising a plate-shaped shoe made of hard rubber and placed on said upper wedge-shaped pressure receiving member.

8. A bridge bearing device according to claim 6, further comprising; an plate-shaped shoe made of hard rubber and having its lower portion fitted in a recessed portion formed in the upper face of said upper wedge-shaped pressure receiving member; and an upper shoe adapted to be attached to the lower face of said bridge and slidably placed on the plate-shaped shoe.

9. A bridge bearing device according to claim 8, wherein said plate-shaped shoe is formed at least on its upper face with a slide layer having a small sliding frictional resistance.

10. A bridge bearing device according to claim 6, further comprising a base plate formed on its upper face with both a sliding face of said wedge-shaped drive member and position regulating members for moving said wedge-shaped drive member only in the longitudinal direction, said base plate being laid below said wedge-shaped drive member and adapted to be fixed on a lower structure for said bridge.

11. A bridge beating device according to claim 6, further comprising means for moving said wedge-shaped drive member, said means including a hydraulic center hole jack having a drive portion and a sliding rod extending through said jack and having a leading end removably connected to said wedge-shaped drive member and an other end associated with the drive portion of said jack so that said jack can be removed after said bridge has been raised.

* * * * *